US010753145B2

(12) United States Patent
Biedermann

(10) Patent No.: US 10,753,145 B2
(45) Date of Patent: Aug. 25, 2020

(54) MOTORIZED SHADE APPARATUS

(71) Applicant: David T. Biedermann, Mooresville, NC (US)

(72) Inventor: David T. Biedermann, Mooresville, NC (US)

( * ) Notice: Subject to any disclaimer, the term of this patent is extended or adjusted under 35 U.S.C. 154(b) by 218 days.

(21) Appl. No.: 15/838,074

(22) Filed: Dec. 11, 2017

(65) Prior Publication Data

US 2018/0163465 A1 Jun. 14, 2018

Related U.S. Application Data

(60) Provisional application No. 62/432,607, filed on Dec. 11, 2016.

(51) Int. Cl.
*E06B 9/42* (2006.01)
*E06B 9/50* (2006.01)
*E06B 9/72* (2006.01)

(52) U.S. Cl.
CPC ..... *E06B 9/42* (2013.01); *E06B 9/50* (2013.01); *E06B 9/72* (2013.01)

(58) Field of Classification Search
CPC ..... E06B 9/42; E06B 9/72; E06B 9/50
USPC .... 160/1, 7, 127, 238, 311, 330, 333, 368.1, 160/DIG. 17
See application file for complete search history.

(56) References Cited

U.S. PATENT DOCUMENTS

| | | | | |
|---|---|---|---|---|
| 6,181,089 | B1 | 1/2001 | Kovach et al. | |
| 6,446,693 | B1 | 9/2002 | Anderson et al. | |
| 7,401,634 | B2 | 7/2008 | Kovach et al. | |
| 7,517,609 | B2 | 4/2009 | Cheng | |
| 7,673,667 | B2 | 3/2010 | Domel et al. | |
| 7,823,620 | B2 | 11/2010 | Kirby | |
| 8,371,358 | B1 | 2/2013 | Mullet et al. | |
| 9,060,636 | B2 | 6/2015 | Cannaverde | |
| 9,488,000 | B2 | 11/2016 | Kirby et al. | |
| 9,745,796 | B2 | 8/2017 | Blair et al. | |
| 2016/0123076 | A1* | 5/2016 | Kirby | E06B 9/72 160/10 |
| 2016/0201389 | A1* | 7/2016 | Oakley | E06B 9/322 160/368.1 |

* cited by examiner

*Primary Examiner* — Justin V Lewis

(57) ABSTRACT

A motorized shade apparatus for windows includes a power supply unit, such as a tube of large capacity batteries which may have long cycle life. All or all large system components can be hidden from view such as behind a valance or other covering. In an embodiment of the invention, the power supply current can be conveyed via integral connections with the motor/shade assembly. The system can be installed at-location in parts or modules. The valance, power supply, and motor assembly can be removed easily to replace components over time without complex mechanisms that increase cost or introduce disadvantages such as louder operational noises.

18 Claims, 18 Drawing Sheets

MOTORIZED SHADE APPARATUS

CROSS REFERENCE TO RELATED APPLICATIONS

This application claims priority to U.S. Provisional Patent Application No. 62/432,607, filed Dec. 11, 2016 and incorporated herein by reference.

TECHNICAL FIELD AND BACKGROUND OF INVENTION

The present invention relates to window coverings, such as curtains and shades. One embodiment of the invention comprises a motorized window covering apparatus comprising a detachable power supply unit.

Window coverings, such as curtains and shades, are known in the art and are used to provide privacy, to limit the amount of light that can pass through a window and into a room or building, and to decorate rooms and provide aesthetic appearances. Roller shades and cellular shades are types of window coverings that comprise material that rolls up, or compresses onto itself. Generally, they are easy to install, are available in many colors and opacities, and are easy to maintain over their life. Also known in the art are motorized shades, which comprise a motor that raises and lowers the shade. This provides added convenience to the user, who can raise or lower the shade to their preference, without manually handling the shades. Such motorized shades can include switches or remote controls.

Motorized shades are generally difficult and costly to install, especially when directly connected to household power as an electrician or other expert or professional is often required for installation. Motorized shades powered by batteries or plug-in adapters from household outlets do not require such professional expertise for installation, and are therefore generally less complex and less expensive to install. Current powered shade systems, however, suffer from disadvantages, such as the following:

Only small size batteries with limited energy capacity fit into the minimal cross-sectional area between the valance and headrail system for motorized shades, because they utilize many of the same parts (brackets, shade material, head rail and valance) as non-motorized shades to reduce the significantly higher cost for motorization. Or the power supply (especially a group of common cell batteries) is positioned outside the headrail or valance, but still utilize small size batteries to minimize adverse aesthetics as they look conspicuous and unnatural.

Systems that minimize cross-sectional area and volume by utilizing a small sized power supply (such as common AA cell sized batteries) compromise cycle life compared to larger diameter batteries (such as common C or D cell sized batteries). For example, while typical D cell size batteries have more than five times larger cross-sectional area compared to typical AA cell size batteries, they have approximately eight times more energy capacity for significantly longer cycle life for motorized shades.

Installation of whole systems (designed to fit together prior to installation) can be heavy and awkward to install, often at unstable positions many feet above the floor. Individual parts that install separately to form the system at the final location are easier to handle, because individual pieces are lighter in weight and less bulky.

All the above disadvantages increase the difficulty of installation and/or detract from the cycle life expectations and/or aesthetics of the motorized shade. Therefore, a need exists in the field for motorized shade systems that retain pleasing aesthetics with significantly longer cycle life. A further need exists to utilize a larger capacity power supply that significantly increases cycle life, again without being located external to the system and compromising aesthetics. Another need exists for simplified installation, whereby system parts are installed in pieces or modules to lessen weight and awkward handling.

SUMMARY OF INVENTION

Therefore, one object of the present invention is to provide a motorized window covering apparatus having pleasing aesthetics and does not include an externally placed power supply. Another object of the present invention is to provide a motorized shade system comprising a large capacity power supply that is not located external to the system and does not compromise aesthetics. Another object of the invention is to provide a motorized shade system that can be installed in pieces or modules. Another object of the invention is to provide a motorized shade apparatus comprising a power supply that comprises battery container that can be easily detached and reattached to the apparatus to facilitate replacement of the batteries. These and other objects of the invention can be achieved in various embodiments of the invention described herein.

Embodiments of the invention can comprise a motorized shade apparatus with a power supply, such as a tube of large capacity batteries which may have long cycle life, whereby all or all large system components may be hidden from view such as behind a valance or other covering. In an embodiment of the invention, a simplified method of installation is provided whereby the power supply and the motor and shade assembly are easily connected without manual wiring to a bracket, and the power supply current can be conveyed via integral connections with the motor/shade assembly, also without the need for manual wiring. The system can be installed at-location in parts or modules such as: brackets, then motor/shade assembly, then power supply, then valance or other covering to cover or hide all the parts, enabling less cumbersome installation. The valance, power supply, and motor assembly can be removed easily to replace components over time without complex mechanisms that increase cost or introduce disadvantages such as louder operational noises.

An embodiment of the invention comprises a motorized window covering apparatus comprising a bracket assembly adapted for attachment to an architectural structure, a window covering assembly connected to and supported by the bracket assembly, and a power supply unit operatively connected to the motor to power the motor. The window covering assembly comprises a window covering and a motor operatively connected to the window covering and adapted for raising and lowering the window covering. The power supply unit is removably attached to the bracket assembly and positioned in spaced-apart relation to the window covering assembly.

According to another embodiment of the invention, the bracket assembly comprises first and second brackets that are attached to an architectural structure, such as wall proximate a window.

According to another embodiment of the invention, the power supply unit comprises a substantially elongate structure adapted to contain a plurality of batteries therein. According to an embodiment of the invention, the power supply elongate structure has an area of at least 0.75 square inches.

According to another embodiment of the invention, the power supply unit comprises a substantially cylindrical elongate tube comprising an electrically conductive material and adapted to contain a plurality of batteries therein.

According to another embodiment of the invention, the elongate tube has a diameter of at least one inch.

According to another embodiment of the invention, the elongate tube is adapted to contain a plurality of D cell batteries therein.

According to another embodiment of the invention, at least one power supply tab extends outwardly from the elongate tube, and a spring member is positioned on the first bracket and at least one bracket tab extends outwardly from the first bracket. The bracket tab is adapted for complementary engagement with the power supply tab, and the spring member provides a countervailing force on the elongate tube when the power supply tab engages the bracket tab, whereby the elongate tube is removably attached to the first bracket.

According to another embodiment of the invention, the bracket tab is comprised of an electrically conductive material and the power supply tab is comprised of an electrically conductive material. The bracket tab is electrically connected to the motor, such that the power supply unit is electrically connected to the motor when the elongate tube is attached to the first bracket.

According to another embodiment of the invention, the window covering is a window shade and the window covering assembly that supports the shade. The motor operatively connected to the shade to facilitate vertical movement of the shade, and further wherein the shade is attached to the first bracket and the second bracket.

According to another embodiment of the invention, the elongate power supply tube can be detached from the first bracket and reattached to the first bracket without moving the window shade.

According to another embodiment of the invention, a cross-sectional area of the longitudinal volume of the first bracket defines more than 0.75 square inches, or approximately a one-inch diameter of area for the power supply unit.

According to another embodiment of the invention, the power supply unit is not contained within the shade assembly with motor.

According to another embodiment of the invention, the power supply unit is not an integral part of the window covering assembly.

According to another embodiment of the invention, the power supply unit can be detached from the bracket assembly and reattached to the bracket assembly without moving the shade or the shade and motor assembly.

Another embodiment of the invention comprises a motorized window covering apparatus comprising a bracket assembly adapted for attachment to an architectural structure, a window covering assembly connected to and supported by the bracket assembly, a motor operatively connected to the shade and adapted for moving the shade, and a power supply unit operatively connected to the motor to power the motor. The window covering assembly comprises a shade and support assembly, such as a roller, and the power supply unit comprises an elongate tube containing a plurality of batteries therein. The elongate tube is removably attached to the bracket assembly and positioned in spaced-apart relation to the shade roller.

According to another embodiment of the invention, the motor is positioned within the shade assembly, such as the roller, and the elongate tube is not positioned within the shade roller.

According to another embodiment of the invention, the elongate tube has across-sectional area greater than 0.75 square inches, and the plurality of batteries comprises a plurality of D cell batteries.

According to another embodiment of the invention, the elongate tube is substantially cylindrical and has a diameter of at least one inch, and further wherein the plurality of batteries comprises a plurality of D cell batteries.

According to another embodiment of the invention, the shade assembly has multiple power supply structures, each fitting within the same cross-sectional profile of greater than 0.75 square inches.

According to another embodiment of the invention, the bracket assembly comprises a first and second brackets adapted for attachment to an architectural structure, and the shade roller is mounted to the first bracket and the second bracket.

According to another embodiment of the invention, the power supply unit comprises first and second power supply tabs extending outwardly from the elongate tube, and the bracket assembly comprises a spring member positioned on the first bracket and first and second bracket tabs extending outwardly from the first bracket. The first and second bracket tabs are adapted for complementary engagement with the first and second power supply tabs, and the spring member is adapted to provide a countervailing force on the elongate tube when the first and second power supply tabs engage the first and second bracket tabs, whereby the power supply unit is removably attached to the first bracket.

According to another embodiment of the invention, the power supply unit is not an integral part of the window covering assembly, and can be detached from the first bracket and reattached to the first bracket without moving the shade roller.

DETAILED DESCRIPTION OF PREFERRED EMBODIMENTS AND BEST MODE

Figure 1:
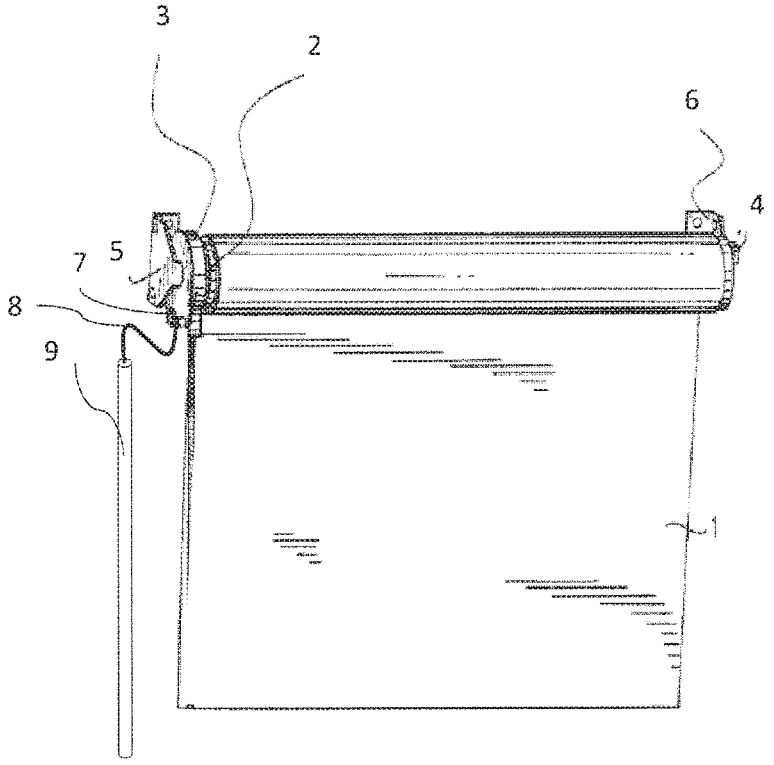
Figure 1 (Prior Art)
FIG. 1 is a front view of a prior art motorized roller shade in which a motor has been installed inside the shade, and the shade has been installed and mounted on brackets.

FIG. 1 shows an example of a prior art mounted motorized roller shade and assembly. In this example, shade material 1 is partially wound around the roller 2. Motor assembly 3 is inserted into one end of roller 2, and pivoting assembly 4 is inserted into the opposite end of the roller 2. Brackets 5, 6 support the shade 1 and roller assembly. The brackets 5, 6 and the pivoting assembly 4 may be constructed by techniques known in the art such as described in U.S. Pat. No. 4,729,418, which is hereby incorporated by reference. In this example, the wires from motor assembly 3 are manually connected via coupling 7 to wire 8 that connects to a power supply 9, which can be a tube of common batteries. Other power sources can be utilized, such as a transformer plugged into a standard household electric outlet. The height of the shade 1 may be adjusted by controlling the motor with a switch or radio remote control.

A motorized shade apparatus according to a preferred embodiment of the invention is illustrated in FIGS. 2-10, and shown generally at reference numeral 50. The apparatus 50 generally comprises a window covering assembly, a motor assembly, a power supply unit operatively connected to the motor assembly, and a mounting assembly on which the window covering assembly and power supply unit can be supported.

The window covering assembly can comprise a shade roller 11 (shown in FIG. 2) and a shade 39 (shown in FIG. 10) supported on the shade roller 11. The mounting assembly can comprise a pair of brackets 13, 14, shown in FIGS. 2, 4, and 5 that are adapted for attachment to an architectural structure, such as a wall.

Figure 2:
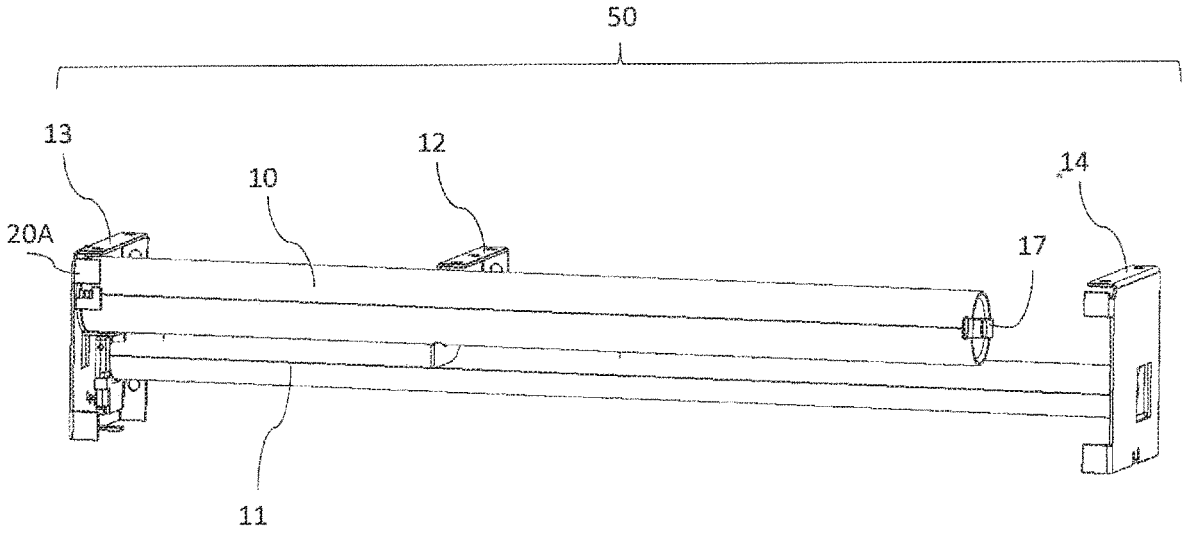
FIG. 2 is a perspective view of a motorized shade apparatus according to a preferred embodiment of the invention.
Figure 4:
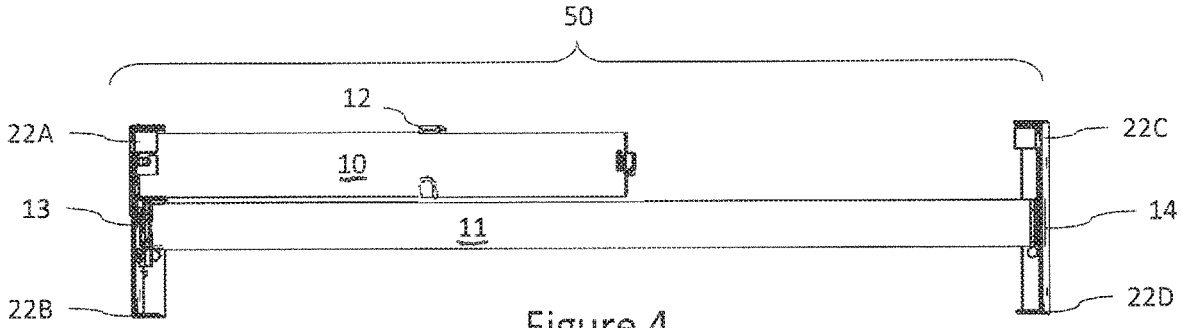
FIG. 4 is another front elevational view of the motorized shade apparatus of FIG. 2, shown without the valance and side covers.
Figure 5:
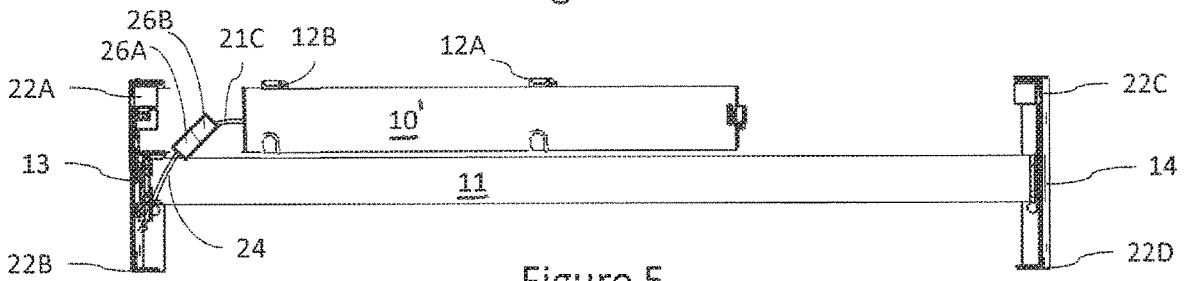
FIG. 5 is a front elevational view of a motorized shade apparatus according to an alternative embodiment of the invention.
Figure 6A:
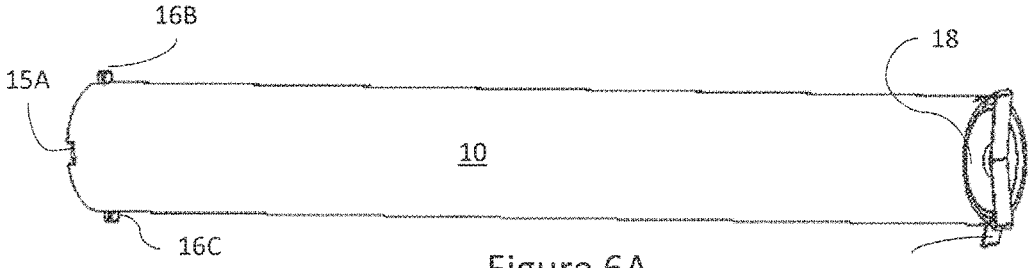
FIG. 6A is a partial perspective view of the motorized shade apparatus of FIG. 2, showing the front right side of an exemplary power supply and components.
Figure 6B:
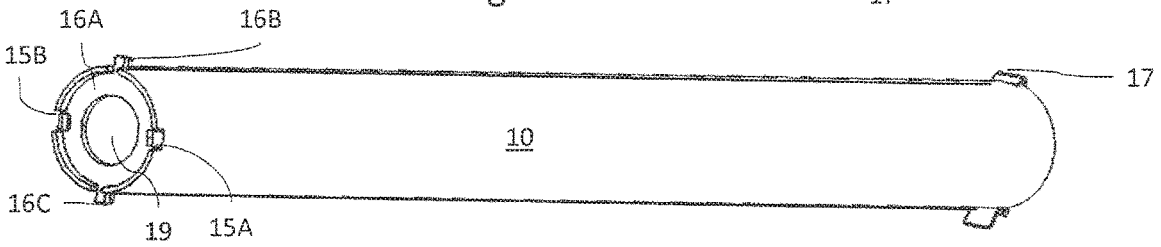
FIG. 6B is another partial perspective view of the motorized shade apparatus of FIG. 2, showing the front left side of an exemplary power supply and components.
Figure 6C:
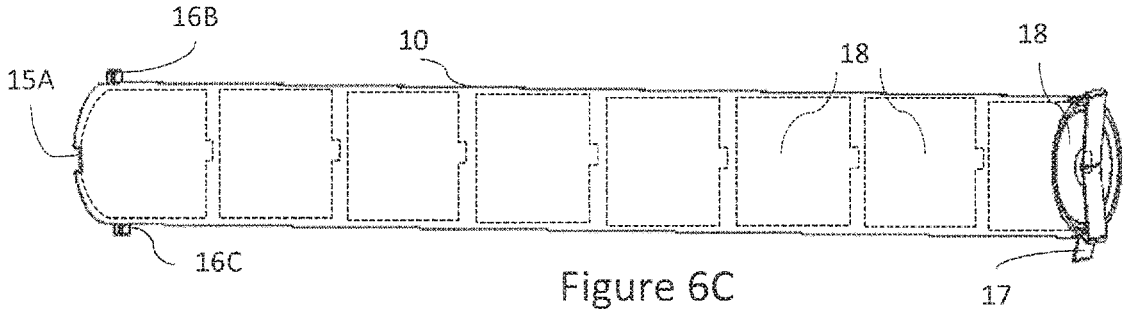
FIG. 6C is another partial perspective view of the motorized shade apparatus of FIG. 2, showing batteries located inside the power supply unit.

The power supply unit can be an elongate structure, such as a cylindrical tube 10 comprised of a rigid material with an inner diameter sufficient to hold large, commonly available batteries, such as D-cell size alkaline batteries, as shown in FIG. 6C. Preferably, the power supply has an area at least 0.75 square inches, such as the power supply tube 10 that has a diameter of one inch or greater. As shown in FIGS. 2 and 4, one end of the power supply tube 10 can be coupled mechanically to bracket 13, while the other end can be supported by an intermediate bracket 12, which has passage ways sufficient in cross-sectional area for the power supply tube 10 and allows the shade to operate unencumbered. Bracket 13 can also support one end of the motor assembly covered by the roller shade 11, as the other end is supported by end bracket 14, horizontally opposed to the first end bracket 13. All brackets 13, 14 can be made of rigid material, such as metal, and are secured to a permanent structure surrounding the window opening with fasteners such as common screws, nails, or the like. In an alternative embodiment, the power supply tube 10 can be supported by first and second intermediate brackets 12A, 12B, as shown in FIG. 5. The insulated electrical wires 21C from the power supply tube 10 connect to insulated electrical wires 24B to the motor, either directly, or with common connectors such as wire nuts, or with specialty terminal connectors 26A and 26B that are designed to conveniently mate.

FIGS. 6A and 6B show the power supply tube 10 in two views. FIG. 6A shows the front right side, and FIG. 6B shows the front left side. The power supply tube 10 can hold a plurality of batteries such as 8 D-cell size batteries 18 that are commonly available in the market. One end of the power supply tube 10 holds plate 16A. One method of attachment comprises cutting power supply tube tabs 15A, 15B from power supply tube 10 ends to fit and secure plate tabs 16B, 16C via crimping. The power supply tube tabs 16B, 16C also serve to connect securely with the bracket assembly 13. The plate 16A, which is comprised of electrically non-conductive material, such as plastic, can include a center hole 19 large enough for a spring 21A to directly contact the batteries 18 inside the power supply tube 10 and conduct electric current. On the other end of the power supply tube 10, an end closure 17, such as a cap, lid, bracket or other, which can be made of flexible and conductive metal, such as spring steel, fastens onto the end of the power supply tube 10 so it secures the batteries 18 and conducts electrical current from the center pip of the batteries to the power supply tube 10.

Figure 6D:
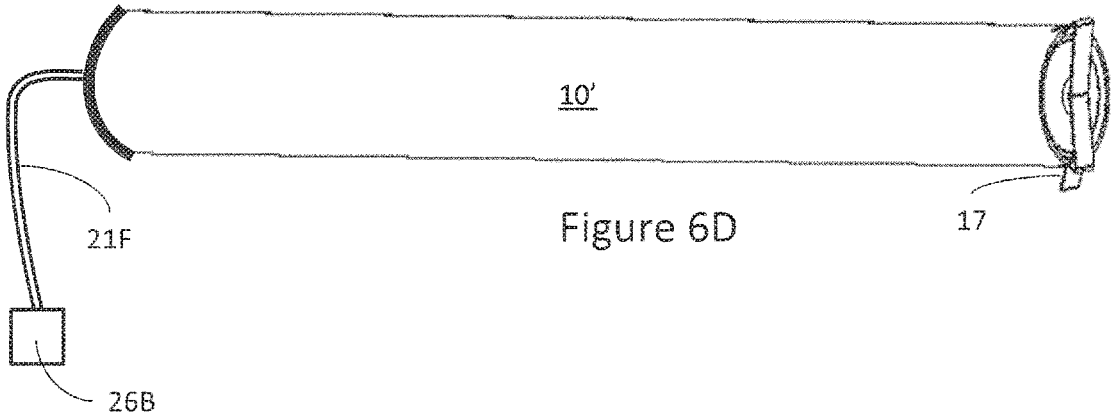
FIG. 6D is a perspective view of a power supply unit according to an alternative embodiment of the invention.

FIG. 6D shows the power supply tube 10' in an alternative embodiment. It can hold a plurality of batteries such as 8 D-cell size batteries 18 that are commonly available in the market. The power supply tube 10' is not mechanically supported by the left bracket 13 or shade and motor assembly. The power supply tube 10' can be independently supported in any of a variety of ways, such as brackets 12A and 12B, shown in FIG. 5, connected to the architectural structure. The power supply tube 10' is designed so its electrical output is conveyed by insulated wires 21E that connect to motor wires, which can be directly connected or by specialty connector 26B.

Figure 7A:
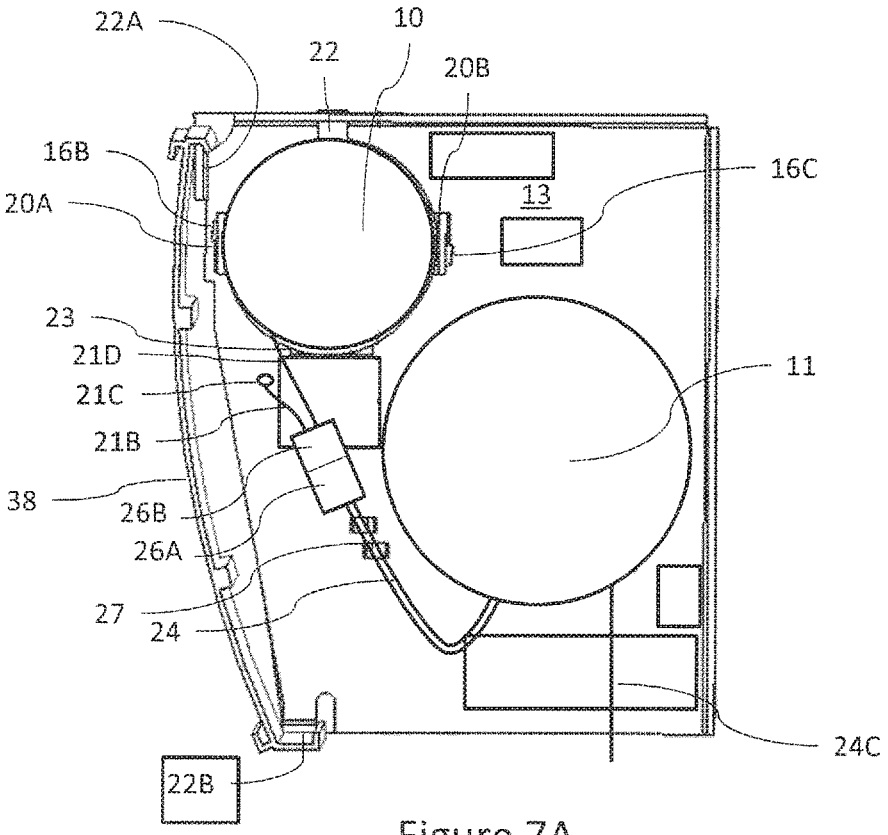
FIG. 7A illustrates the cross-sectional areas of the longitudinal volume that comprise the components of the motorized shade apparatus of FIG. 4.
Figure 7B:
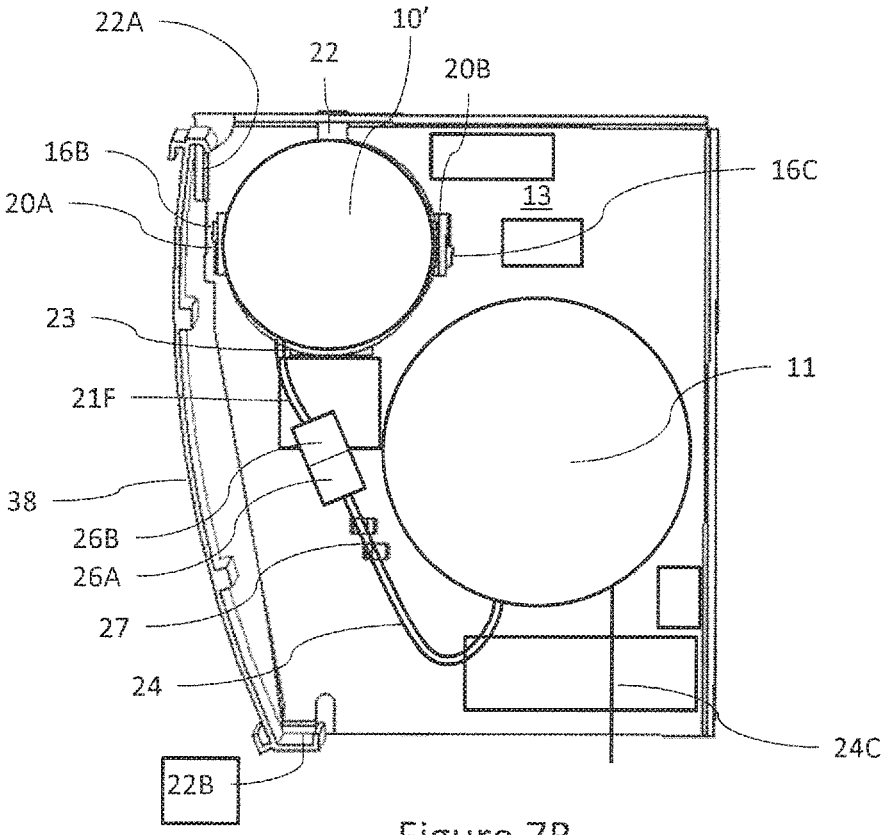
FIG. 7B illustrates the cross-sectional areas of the longitudinal volume that comprise the components of the motorized shade apparatus of FIG. 5.
Figure 8:
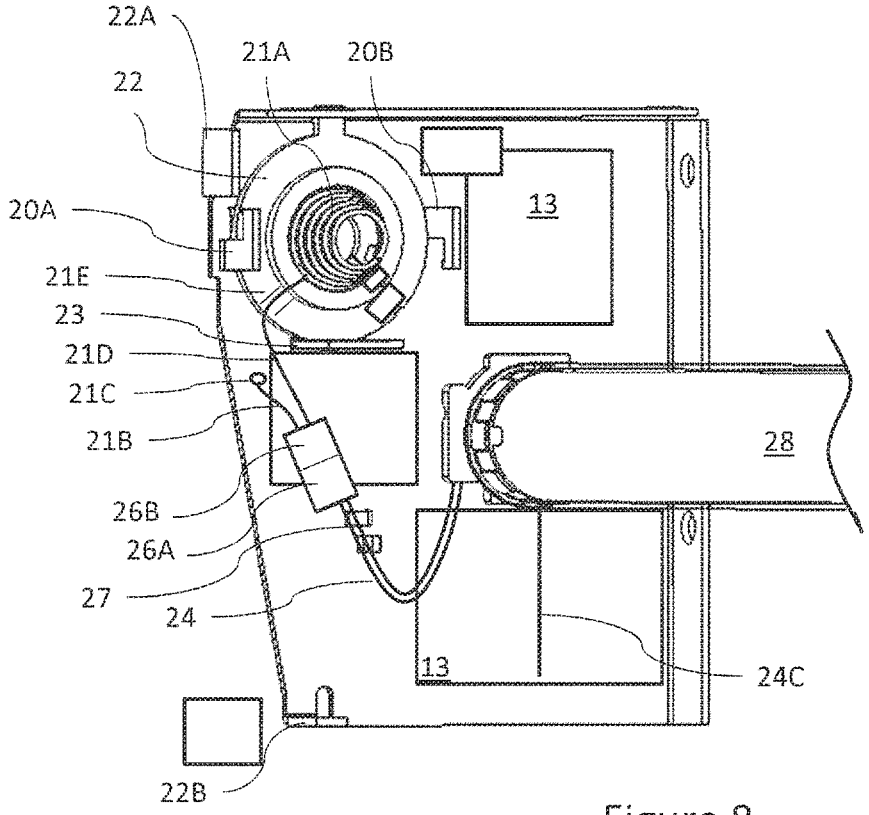
FIG. 8 is a partial perspective view of the motorized shade apparatus of FIG. 2.
Figure 9:
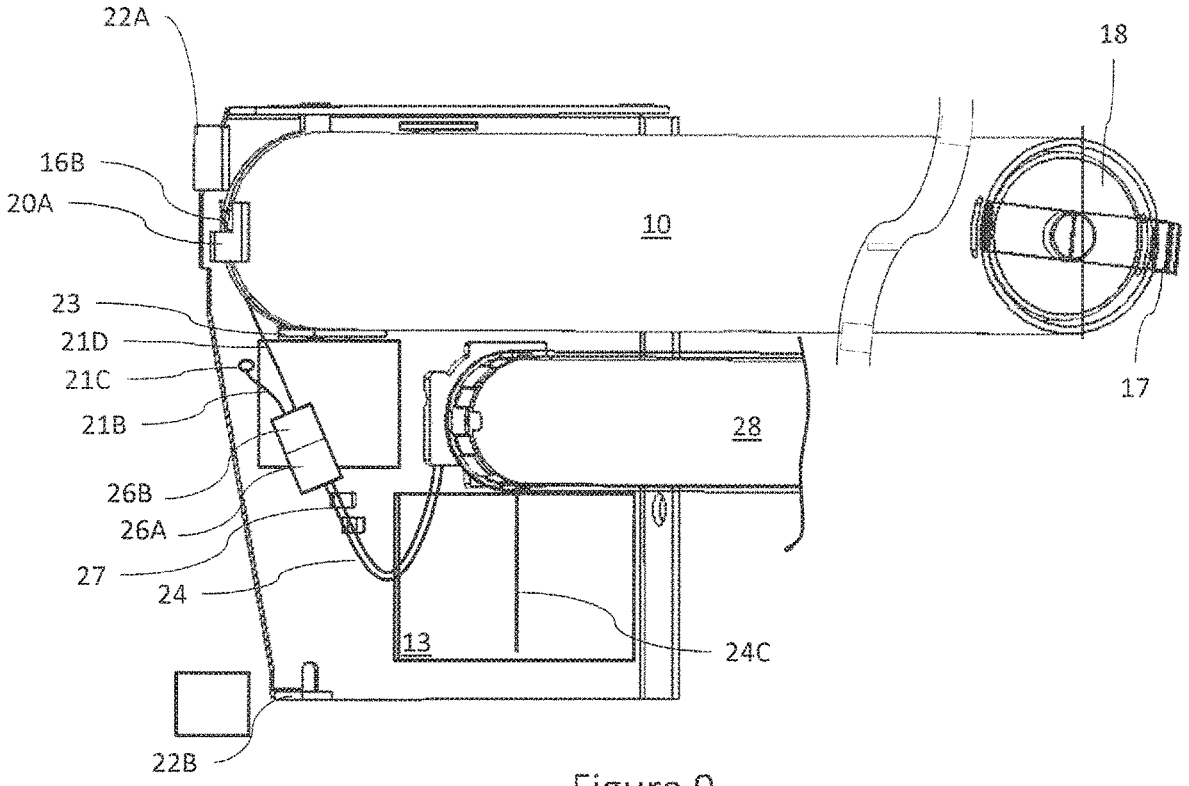
FIG. 9 is another partial perspective view of the motorized shade apparatus of FIG. 2.

FIG. 7A illustrates the cross-sectional areas of the longitudinal volume that comprise the components of shade assembly 50 viewing the left side, with a power supply tube 10 supported by the left bracket 13. FIG. 7B illustrates the same cross-sectional areas of the longitudinal volume that comprise the components of shade assembly 50 viewing the left side, but with a power supply tube 10' that is supported independent of the left bracket 13 or other components of the shade assembly. The areas are bounded by the valance 38, attached and detachable to bracket tabs 22A and 22B and the left side bracket 13. The valance 38 and the left bracket 13 are shown in relation to the cross-sectional area of the power supply tube assembly (10, 16A, 17, 18), and shown in relation to the cross sectional area of the shade and motor assembly 11. The cross-sectional area of the bracket 13 includes more than one-inch diameter continuous free area (parallel with roller shade 11) for the power supply unit 10, which is sufficient to house larger size commonly available batteries, such as C-cell and D-cell size alkaline batteries. The areas for all components are configured so as to preserve the stated area for the power supply, not encumber the operation of the shade, and yet minimize overall area for optimization of cost and aesthetics. The motor assembly within the shade assembly 11 is not shown in FIG. 7, but can be attached as illustrated in FIGS. 8 and 9 to bracket 13 via a variety of mechanisms, including punched extended tabs from the bracket or other separate mechanical connectors. The bracket 13 can comprise an electrically conductive rigid material, such as metal, that has holes along its edges for secure attachment to the architectural structure, such as via fasteners. On the face of the bracket 13, a lower plate 22 made of electrically non-conductive material, such as plastic, can be mechanically coupled to the bracket 13, and has an inner structure that can hold an electrically conductive spring 21A.

The power supply tube 10 can be enclosed and supported within the shade assembly in various ways. The power supply tube 10 can be independently supported by brackets 12A and 12B that attach to the architectural structure. The power supply tube 10 is designed so its electrical output is conveyed by insulated wires 21E that connect to motor wires 24, which can be directly connected or by specialty mated connectors 26A and 26B. When the batteries 18 need to be replaced, the power supply tube can be electrically disconnected from the motor by separating power supply wires 21E from motor wires 24, which can include disconnecting the specialty mating connectors 26A and 26B. Once released from the brackets 12A and 12B, end closure 17 can be removed from the power supply tube 10, and depleted batteries can be emptied from the power supply tube 10, and replaced with new batteries. The end closure 17 can be placed back on to the power supply tube 10, and the power supply tube 10 can be reattached to the brackets 12A and 12B as described above. Electrical connections between 21E and 24 can be restored, which connectors 26A and 26B facilitate. As such, the power supply tube 10 can be easily attached, detached, and reattached from the rest of the apparatus 50, allowing for easy battery replacement.

Figure 9A:
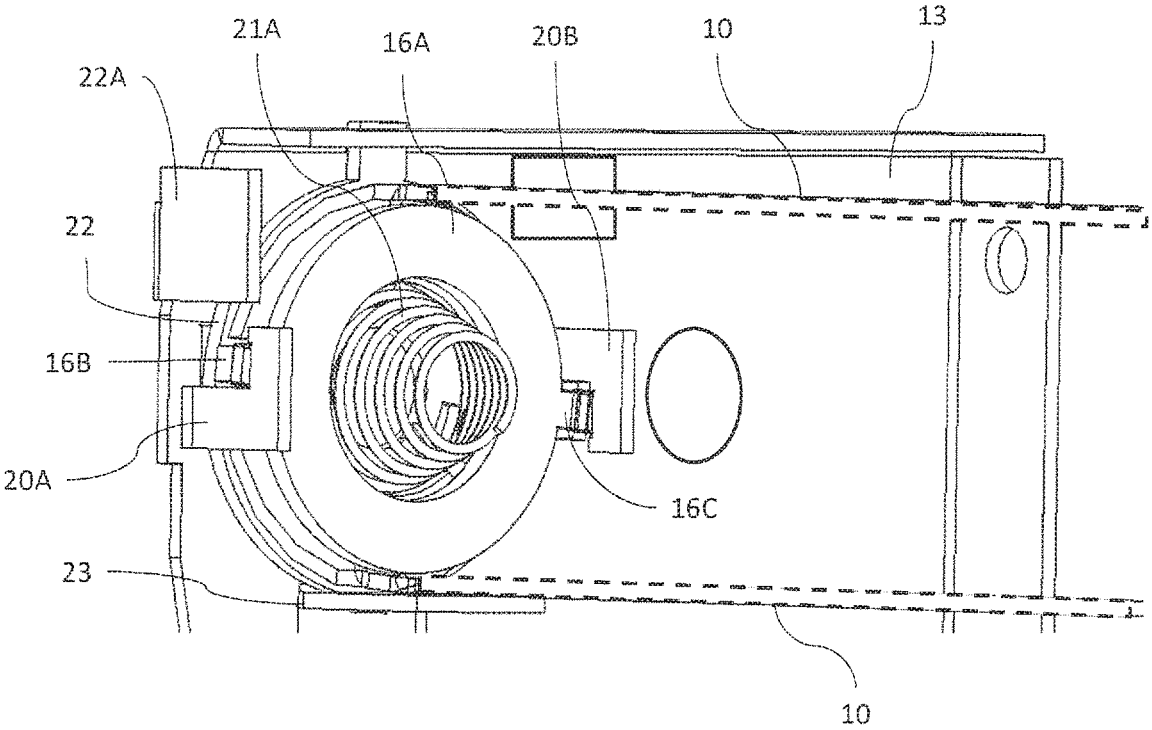
FIG. 9A is another partial perspective view of the motorized shade apparatus of FIG. 2.

The power supply tube 10 can also be supported by bracket tab 23, which can be punched and formed perpendicular to and protruding from the bracket 13. The power supply tube 10 can be secured by bracket tabs 20A, 20B, which can be punched and formed perpendicularly to and protruding from the bracket 13. The power supply tube 10 can connect with a counterclockwise twist motion, whereby the tab extensions 16B, 16C on the power supply tube 10 fit into tabs 20A, 20B, respectively, on the bracket 13, and hold the power supply tube 10 in place by friction as the spring 21A provides counter force, as shown in FIGS. 9 and 9A. When the batteries 18 need to be replaced, the power supply tube can be electrically disconnected from the motor by separating power supply wires 21B and 21D from motor wires 24, which can include disconnecting the mating connectors 26A and 26B. The power supply tube 10 can be detached from the bracket 13 by twisting the tube 10 in clockwise to release tube tab extensions 16B, 16C from the bracket tabs 20A, 20B. Once released from the bracket 13, end closure 17 can be removed from the power supply tube 10, and depleted batteries can be emptied from the power supply tube 10, and replaced with new batteries. The end closure 17 can be placed back on to the power supply tube 10, and the power supply tube 10 can be reattached to the bracket 13 as described above. Electrical connections between 21B, 21D and 24 can be restored, which connectors 26A and 26B facilitate. As such, the power supply tube 10 can be easily attached, detached, and reattached from the rest of the apparatus 50, allowing for easy battery replacement.

Direct electrical contact of the power supply tube 10 with the bracket tabs 20A, 20B enables electrical current from one pole of the power supply tube 10 to be delivered to insulated wire 21B, by solder at point 21C or other electrical conductive method, to feed a wire 24 to the motor, either directly or by mating connectors 26A and 26B. When the power supply tube assembly 10 is secured, the spring 21A can electrically connect the batteries 18 directly through the fitting on the end of the power supply tube 10 and plate 16A, enabling the other pole of the power supply tube 10 to conduct electrical current. This current can be carried by an insulated wire 21D to the motor wires 24, either directly or by mating connectors 26A and 26B. Channel 21E allows wire 21D to pass under the attached power supply tube 10 unobstructed. Bracket punched tabs 27 can hold the wire 24 and keep it out of the way of the shade 39. Tabs 23, 20A and 20B are parts of the bracket that hold parts 21A, 21B, and 22. As such, the left bracket 13 is integral to the power supply, saving both space and parts.

FIG. 8 shows the left side bracket assembly 13 connecting via components to the motor 28, which normally fits inside the roller shade 11 (not shown). The power supply tube 10 is not shown in FIG. 8, but can be attached as illustrated in FIG. 9. An insulated wire 24C from the motor acts as an antenna for the radio motor circuits. In preferred embodiments, all wires are electrically conductive, and are generally in gauge range of 20-24 AWG.

Figure 3:
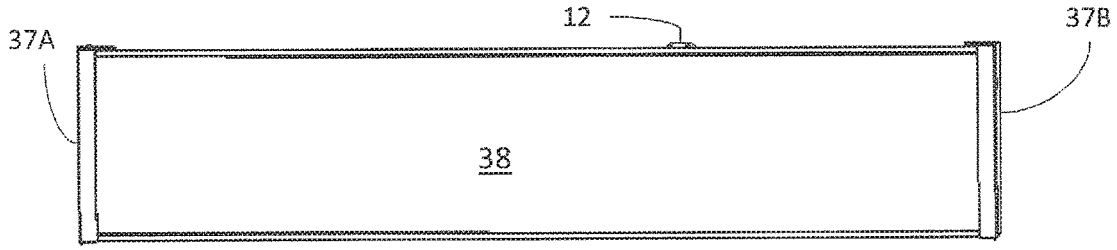
FIG. 3 is front elevational view of the motorized shade apparatus of FIG. 2, with a valance and side covers.
Figure 10:
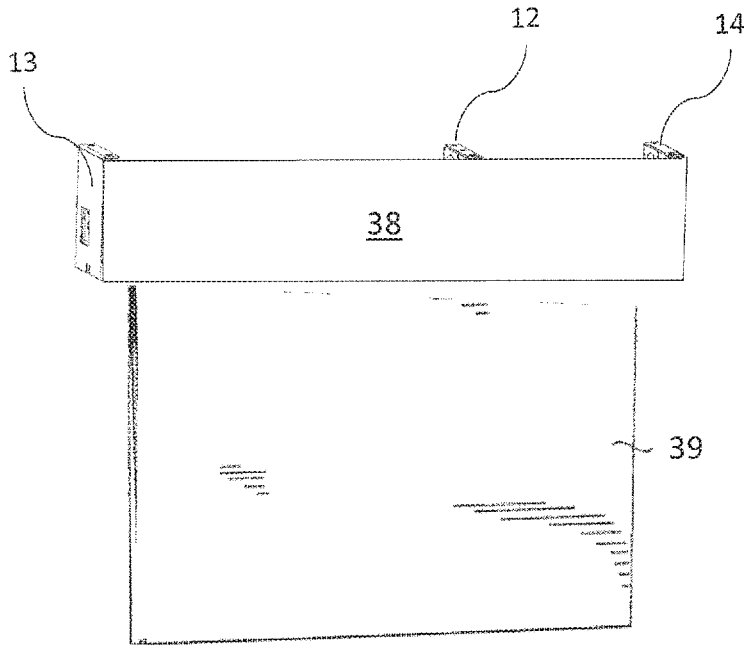
FIG. 10 is a perspective view of the motorized shade apparatus of FIG. 2, showing an example of a final installed product that includes a power supply from a battery tube system, and a valance.

FIG. 10 illustrates the motorized shade apparatus 50 with a fascia such as a valance 38. The valance 38 can be attached to bracket tabs 22A, 22C, shown in FIGS. 4 and 5. FIG. 10 shows the valance 38, which covers the motor 28 and power supply tube 10 and components so those parts are not seen. The valance 38 can be comprised of various materials, such as plastic, metals, textiles, and cloths. The valance 38 can attach securely over an/or around brackets 12, 13, 14, and is removable. The valance 38 conceals all or all large system components, such as the motor 28, brackets 13, 14, and power supply unit 10, from view. The shade 39 can move up into the valance 38 to be concealed, or can be moved down to cover the window. The apparatus 50 can include side covers 37A, 37B attached to brackets 13, 14, respectively, as shown in FIG. 3. The power supply 10 is not structurally attached to (or an integral part of) the valance, motor assembly or shade.

As shown in FIGS. 2 and 4, the power supply tube 10 is separate from and positioned in spaced-apart relation to the roller shade 11. This provides advantages over prior art devices, in which the power supply is housed inside of the roller shade. These advantages include avoidance of the complex mechanical connections that are required when batteries are housed internally of the roller shade to prevent the batteries from rotating within the roller shade while the shade itself is rotating. Such rotating batteries can create noise and increase energy requirements. In addition, locating batteries inside the roller shade requires space that increases the width of the entire shade past many desirable shade widths for consumers. For example, a typical twelve-volt tubular motor using D-cell batteries will measure minimally thirty-two inches wide. Twenty inches must be provided for the batteries, and twelve inches for the motor. Many consumers desire shades less than thirty-two inches to properly fit their windows. By positioning the power supply 10 outside the roller shade 11, the apparatus 50 can provide a roller shade 11 of far less width, such as about twelve inches. Furthermore, removing and replacing batteries that are positioned inside the roller shade is more burdensome as one must first gain access to the inside of the roller shade. Removing and replacing batteries in the battery tube 10 of the apparatus 50 is easier since it does not require the user to handle the roller shade 11 in any way.

Figure 11:
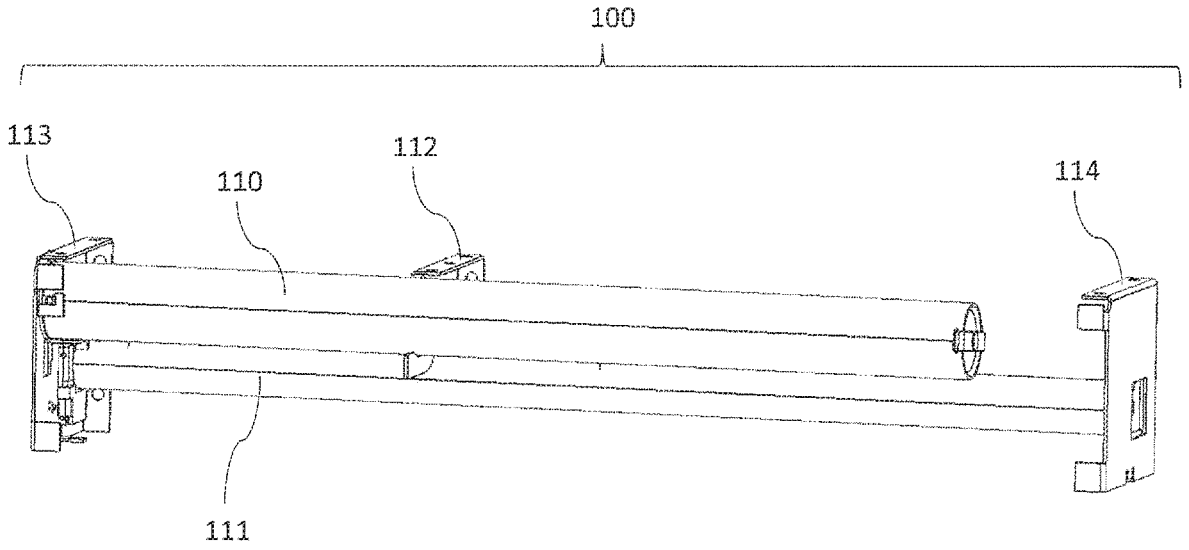
FIG. 11 is a perspective view of a motorized shade apparatus according to a preferred embodiment of the invention, illustrating a connection of the motor and power supply to the bracket.

A motorized shade apparatus according to another preferred embodiment of the invention is illustrated in FIGS. 11-16, and shown generally at reference numeral 100. The apparatus 100 comprises a power supply unit 110 that provides necessary energy for a motor 128. As shown in FIG. 11, the power supply unit 110 can be an elongate tube comprised of an electrically conductive rigid material, such as aluminum, with an inner diameter sufficient to hold large, commonly available batteries, such as D-cell size alkaline batteries. One end of the power supply tube 110 can be coupled mechanically to a bracket 113, while the other end can be supported by a second intermediate bracket 112, which has passage ways sufficient in size to hold the power supply tube 110 and allow the shade to operate unencumbered. Bracket 113 can also support one end of the motor assembly covered by the roller shade 111, as the other end is supported by end bracket 114, horizontally opposed to the first end bracket 113. All brackets 113, 114 can be made of rigid material, such as metal or plastic, and are secured to a permanent structure surrounding the window opening with fasteners such as common screws, nails, or the like.

Figure 12A:
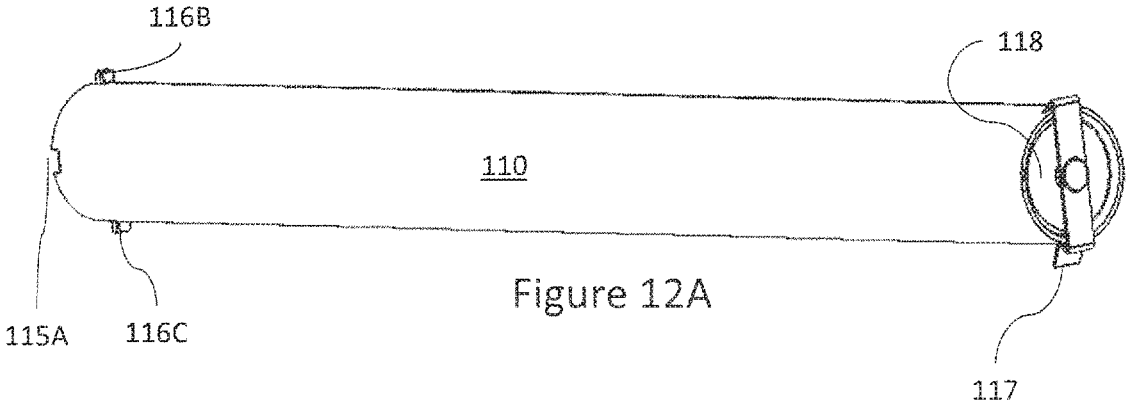
FIG. 12A is a partial perspective view of the motorized shade apparatus of FIG. 11, showing the front right side of an exemplary power supply and components.
Figure 12B:
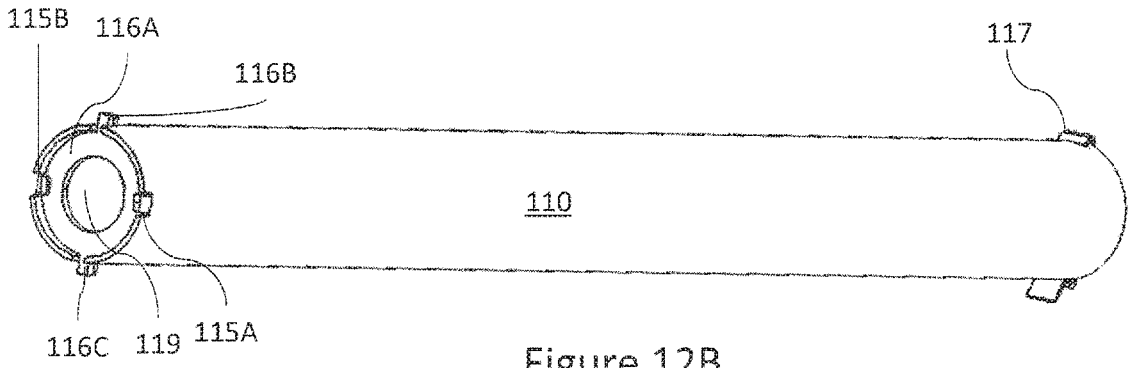
FIG. 12B is another partial perspective view of the motorized shade apparatus of FIG. 11, showing the front left side of an exemplary power supply and components.
Figure 13:
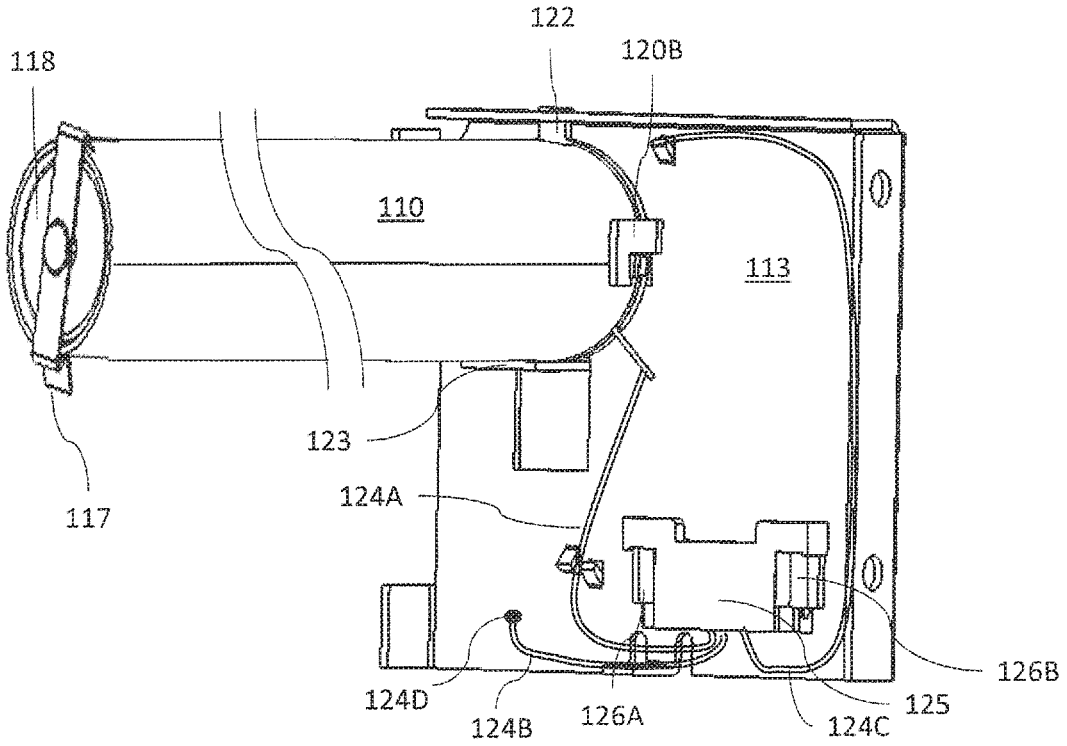
FIG. 13 is another partial perspective view of the motorized shade apparatus of FIG. 11, showing an example connection of the power supply components from a battery tube system to the bracket.

FIGS. 12A and 12B show the power supply tube 110 in two views. FIG. 12A shows the front right side, and FIG. 12B shows the front left side. The power supply tube 10 can hold a plurality of batteries such as 8 D-cell size batteries 118. One end of the power supply tube 110 holds plate 116A. One method of attachment comprises cutting power supply tube tabs 115A, 115B from power supply tube 110 ends to fit and secure plate tabs 116B, 116C via crimping. The power supply tube tabs 116B, 116C serve to connect the power supply tube 110 securely with the bracket assembly 113, as shown in FIG. 13. The plate 116A, which is comprised of electrically non-conductive material, such as plastic, can include a center hole 119 large enough for a spring 121A to directly contact the batteries 118 inside the power supply tube 110 and conduct electric current. On the other end of the power supply tube 110, an end closure 117, such as a cap, lid, bracket or other, which can be made of flexible and conductive metal, such as spring steel, fastens onto the end of the power supply tube 110 so it secures the batteries 118 and conducts electrical current from the center pip of the batteries to the power supply tube 110.

Figure 14:
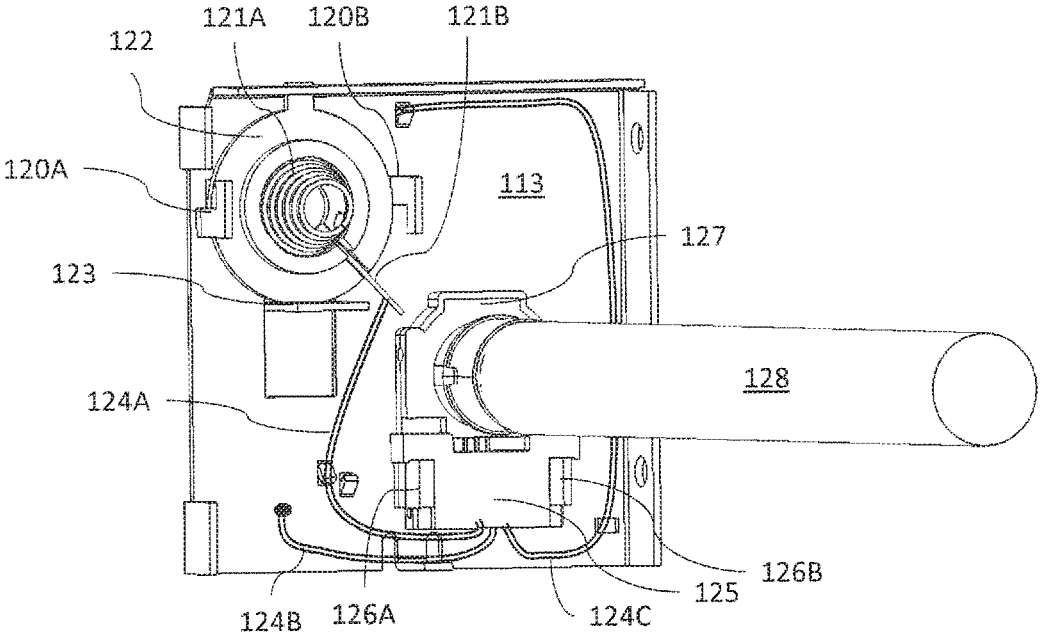
FIG. 14 is another partial perspective view of the motorized shade apparatus of FIG. 11, showing an example connection of the motor assembly to the bracket.

FIG. 13 illustrates the left side bracket 113 with the power supply tube assembly (110, 117, 118) attached. The motor assembly is not shown in FIG. 13, but can be attached as illustrated in FIG. 14. The bracket 113 can comprise an electrically conductive rigid material, such as metal, that has holes along its edges for secure attachment to the architectural structure, such as via fasteners. On the face of the bracket 113, a lower plate 122 made of electrically non-conductive material, such as plastic, can be mechanically coupled to the bracket 113, and has an inner structure that can hold an electrically conductive spring 121A. The power supply tube 110 can be supported by bracket tab 123, which can be punched and formed perpendicular to and protruding from the bracket 113. The power supply tube 10 can be secured by bracket tabs 120A, 120B, which also can be punched and formed perpendicularly to and protruding from the bracket 113. The power supply tube 110 can connect to the bracket 113 with a twist motion, whereby the tab extensions 116B, 116C on the power supply tube 110 fit into tabs 120A, 120B on the bracket 113, and hold the power supply tube 110 in place by friction as the spring 121A provides counter force. The power supply tube 110 can be secured and unsecured in this manner or using other coupling techniques known in the art, facilitating power supply replacement. Direct electrical contact of the power supply tube 110 with the bracket tabs 120A, 120B enables electrical current from one pole of the power supply tube 110 to be delivered to insulated wire 124B, which then can be connected, by solder at point 124D or other electrical conductive method, to feed a connector in the lower connector assembly 125. When the power supply tube assembly 110 is secured, the spring 121A can electrically connect the batteries 118 directly through the fitting on the end of the power supply tube 110 and plate 116A, enabling the other pole of the power supply tube 110 to conduct electrical current. In some embodiments, this current is carried by spring spur 121B, which is connected, by solder or other electrical conductive method, to an insulated wire 124A that feeds the lower connector assembly 125.

FIG. 14 shows the left side bracket assembly 113 connecting via components to the motor 128, which normally fits inside the roller shade 111 (not shown). The power supply tube 110 is not shown in FIG. 14, but can be attached as illustrated in FIG. 13. An insulated wire 124C can be connected from the lower connector assembly 125 and can be fastened to the bracket 113 for its length inside the bracket 113 to act as an antenna for the radio motor circuits. In preferred embodiments, all wires are electrically conductive, and are generally in gauge range of 20-24 AWG. The motor control housing 127, which attaches to and supports the motor 128, fits into the lower connector assembly 125, which is attached to bracket 113, such as by support tabs 126A, 126B, which can be punched and formed perpendicularly to and protruding from the bracket 113.

Figure 15A:
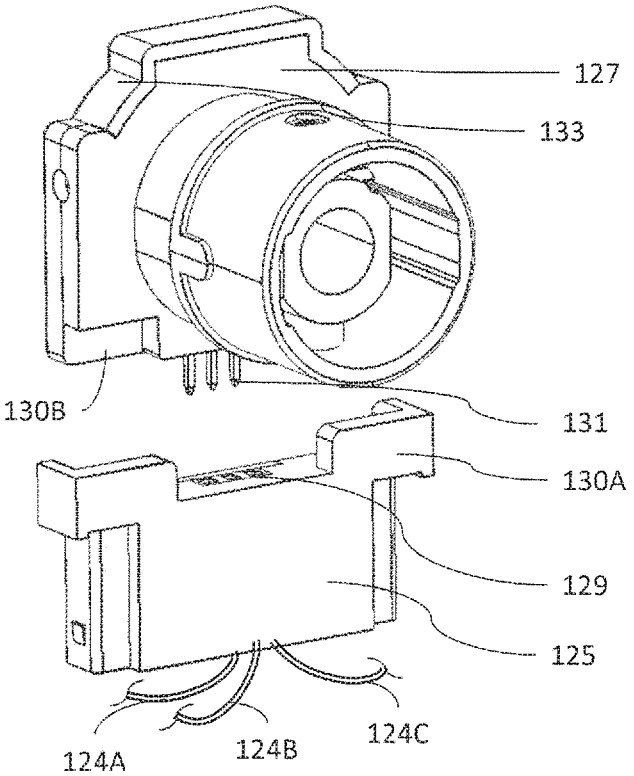
FIG. 15A is another partial perspective view of the motorized shade apparatus of FIG. 11, showing an example a motor head assembly.
Figure 15B:
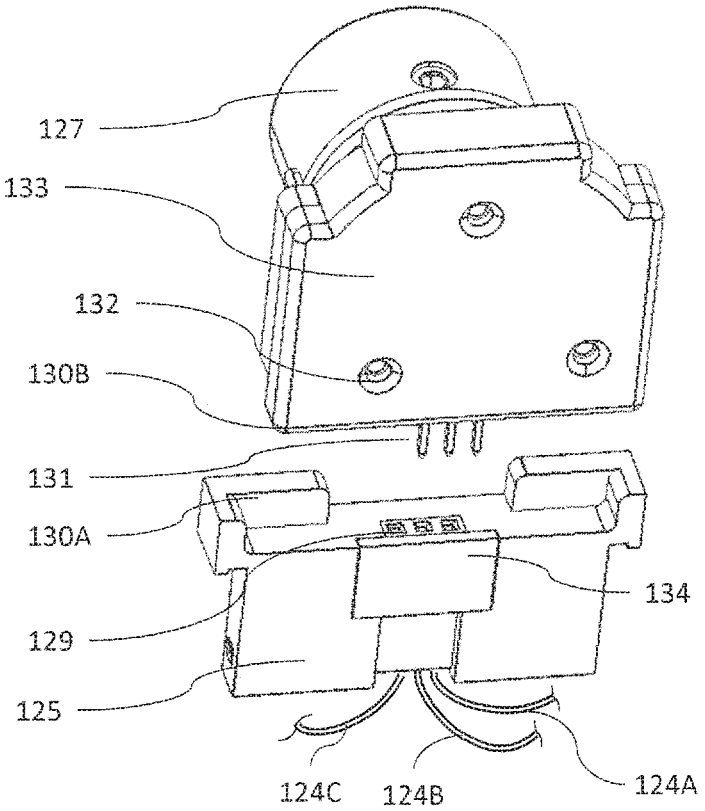
FIG. 15B is another partial perspective view of the motorized shade apparatus of FIG. 11, showing a rear view of an example of a motor head assembly.

FIGS. 15A and 15B illustrate the lower connector assembly 125 and motor control housing 127 in two views (front view FIG. 15A and back view FIG. 15B). Male pins 131 extend downwardly from the motor control housing 127, and the male pins 131 directly connect to the motor 128. The motor control housing 127 closely fits with motor control housing cover 133, attached with screws 132 or by other means. In this embodiment, the motor assembly (127, 128, 131, 133) mates with the lower control assembly 125, with complementary tabs 130A, 130B providing interference upon mating to prevent the motor assembly from detaching from the bracket assembly. The lower connector housing 125 can contain a female connector 129 that houses metal contacts for temporary connection above with male pins 131, and permanent connection via welding, solder, or other method with wires 124A, 124B to provide electrical current via male pins 131 to the motor 128, and with wire 124C for antennae signal via male pins 131 to the motor. A small plate 134 can be coupled to the back of the female connector 129 to secure it with the lower connector assembly 125. In preferred embodiments, the male pins 131 extend from the motor control housing 127 and motor control housing cover 133, and temporarily connect with metal contacts in female connector 129 without additional effort when the motor assembly is placed onto the lower connector assembly 125, allowing attachment and reattachment for ease of installation and maintenance.

Figure 16:
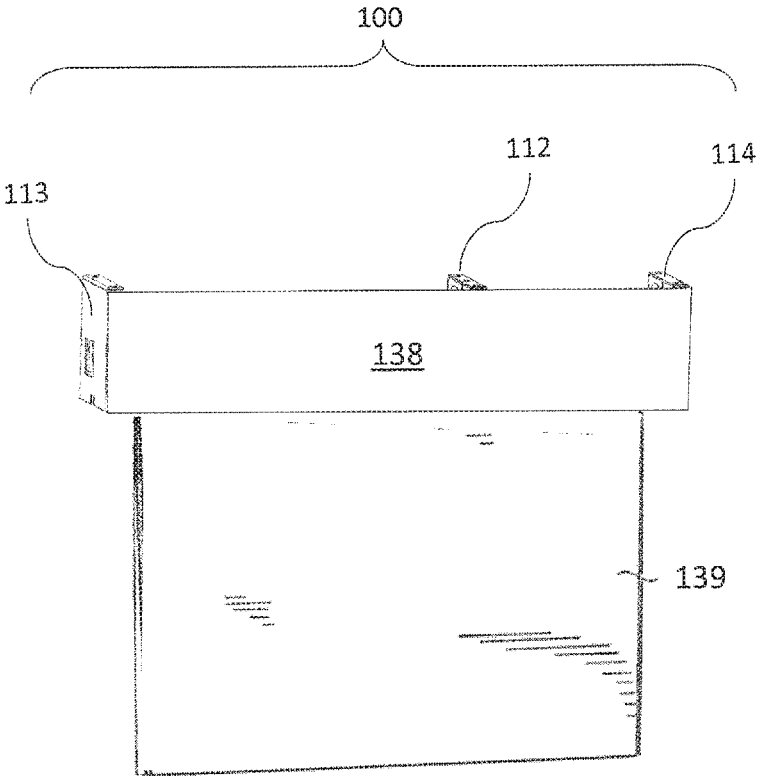
FIG. 16 is a perspective view of the motorized shade apparatus of FIG. 11, showing an example of a final installed product that includes a power supply from a battery tube system, and a valance.

FIG. 16 illustrates the motorized shade apparatus 100 with a cover such as a valance 138. FIG. 16 shows the valance 138, which covers the motor 128 and power supply tube 110 and components so those parts are not seen. The valance 138 can be comprised of various materials, such as plastic, metals, textiles, and cloths. The valance 138 can attach securely over an/or around brackets 112, 113, 114, and is removable. The valance 138 conceals all or all large system components, such as the motor 128, brackets 113, 114, and power supply unit 110, from view. The shade 139 can move up into the valance 138 to be concealed, or can be moved down to cover the window.

A motorized shade apparatus is described above. Various changes can be made to the invention without departing from its scope. The above description of embodiments of the invention and the best mode of carrying out the invention is provided for the purpose of illustration only and not limitation—the invention being defined by the claims and equivalents thereof.

What is claimed is:

1. A motorized window covering apparatus comprising:
(a) a bracket assembly adapted for attachment to an architectural structure, the bracket assembly comprising a first bracket adapted for attachment to the architectural structure and a second bracket adapted for attachment to the architectural structure;
(b) a window covering assembly connected to and supported by the bracket assembly, the window covering assembly comprising a window covering and a motor operatively connected to the window covering and adapted for raising and lowering the window covering; and
(c) a power supply unit operatively connected to the motor to power the motor, the power supply unit removably attached to the bracket assembly, the power supply unit spaced apart from the window covering assembly, the power supply unit comprising an elongate structure adapted to contain a plurality of batteries therein and at least one power supply tab extending outwardly from the elongate structure; and
(d) wherein the bracket assembly comprises a spring member positioned on the first bracket and at least one bracket tab extending outwardly from the first bracket, the at least one bracket tab adapted for complementary engagement with the at least one power supply tab, and further wherein the spring member is adapted to provide a countervailing force on the elongate structure when the at least power supply tab engages the at least one bracket tab, whereby the elongate structure is removably attached to the first bracket.

2. The apparatus according claim 1, wherein the power supply unit is adapted to contain a plurality of C cell batteries or D cell batteries therein.

3. The apparatus according to claim 1, wherein the at least one bracket tab is comprised of an electrically conductive material and the at least one power supply tab is comprised of an electrically conductive material, and further wherein the at least one bracket tab is electrically connected to the motor, whereby the power supply unit is electrically connected to the motor when the power supply unit is attached to the first bracket.

4. The apparatus according to claim 1, wherein the window covering assembly comprises a shade, and a shade roller supporting the shade, and further wherein the window covering assembly is attached to the first bracket and the second bracket.

5. The apparatus according to claim 4, wherein the power supply unit can be detached from the first bracket and reattached to the first bracket without moving the shade or the shade roller.

6. The apparatus according to claim 1, wherein the power supply unit is not contained within the window covering assembly.

7. The apparatus according to claim 1, wherein the power supply unit is not attached to the first bracket and is not attached to the second bracket.

8. The apparatus according to claim 4, wherein the power supply unit can be detached from the bracket assembly and reattached to the bracket assembly without moving the shade or the shade roller.

9. A motorized window covering apparatus comprising:
(a) a bracket assembly adapted for attachment to an architectural structure;
(b) a window covering assembly connected to and supported by the bracket assembly, the window covering assembly comprising a shade assembly for supporting a window shade, and a motor operatively connected to the shade assembly and adapted for moving the window shade; and
(c) a power supply unit operatively connected to the motor to power the motor, the power supply unit comprising an elongate structure containing a plurality of batteries therein, the elongate structure removably attached to the bracket assembly, the elongate structure spaced apart from the shade assembly, and wherein the motor is positioned within the shade assembly, and the power supply unit is not positioned within the shade assembly.

10. The apparatus according to claim 9, wherein the plurality of batteries comprises a plurality of C cell batteries or a plurality of D cell batteries.

11. The apparatus according to claim 9, wherein the bracket assembly comprises a first bracket adapted for attachment to an architectural structure and a second bracket adapted for attachment to the architectural structure, and further wherein the shade assembly is mounted to the first bracket and the second bracket.

12. The apparatus according to claim 11, further comprising a valance removably attached to the first bracket and the second bracket, wherein the valance covers the power supply unit from view.

13. The apparatus according to claim 11, wherein the power supply unit is not attached to the first bracket and is not attached to the second bracket.

14. The apparatus according to claim 13, wherein the bracket assembly further comprises a third bracket adapted for attachment to the architectural structure and a fourth bracket adapted for attachment to the architectural structure, the power supply unit received in and supported by the third bracket and the fourth bracket.

15. The apparatus according to claim 9, further comprising a fascia or valance removably attached to the bracket assembly and covering at least a portion of the window covering assembly and at least a portion of the power supply unit from view.

16. The apparatus according to claim 9, wherein the shade assembly comprises a roller, and the window shade is attached to the roller.

17. The apparatus according to claim 16, wherein the power supply unit can be detached from the bracket assembly and reattached to the bracket assembly without moving the window shade or the roller.

18. The apparatus according to claim 9, wherein the motor is controlled by a remote control.

* * * * *